US005741991A

United States Patent [19]

Kurata

[11] Patent Number: 5,741,991

[45] Date of Patent: Apr. 21, 1998

[54] TONE SIGNAL GENERATOR HAVING A SOUND EFFECT FUNCTION AND EFFICIENT MEMORY ACCESS

[75] Inventor: Mitsuhiro Kurata, Hamamatsu, Japan

[73] Assignee: Yamaha Corporation, Hamamatsu, Japan

[21] Appl. No.: 414,929

[22] Filed: Mar. 31, 1995

[30] Foreign Application Priority Data

Mar. 31, 1994 [JP] Japan ..... 6-062561
Mar. 31, 1994 [JP] Japan ..... 6-062564

[51] Int. Cl.[6] ..... G10H 1/02; G10H 7/00

[52] U.S. Cl. ..... 84/627; 84/629; 84/633

[58] Field of Search ..... 84/627, 629, 633, 84/663, 665

[56] References Cited

U.S. PATENT DOCUMENTS

| | | | |
|---|---|---|---|
| 5,123,323 | 6/1992 | Fujita et al. | 84/627 X |
| 5,218,154 | 6/1993 | Kondo | 84/627 X |
| 5,270,478 | 12/1993 | Tetsuji et al. | 84/627 |
| 5,292,997 | 3/1994 | Kato et al. | 84/627 |
| 5,463,183 | 10/1995 | Konno | 84/604 |

*Primary Examiner*—William M. Shoop, Jr.
*Assistant Examiner*—Jeffrey W. Donels
*Attorney, Agent, or Firm*—Pillsbury Madison & Sutro LLP

[57] ABSTRACT

A tone signal generator including a memory for storing tone signal data, a parameter generation device for generating parameter data, and a tone signal data generation device for generating the tone signal data by reading it from the memory, according to the parameter data. The generator includes also a level monitor device for monitoring a level of the tone signal data, and access control device to the memory. The access control device inhibits an access of the tone signal generation device to the memory when the level monitor device detects that the level of the tone signal data monitored is less than a specified value.

Because the access control device inhibits the access of the tone signal generation device when the level of the tone signal data reaches the specified value, any other devices, such as a cpu, can access to the memory device in place of the tone signal generation device.

Another embodiment of the present invention further comprises a phase change control device for changing a generating phase of envelope data from an attack phase to a following phase, when a read address in the attack phase of the tone signal data reaches an end address. This configuration allows the phase timing of the envelope data and the tone signal data to be severely matched.

17 Claims, 12 Drawing Sheets

DSP CIRCUIT

DRAM INTERNAL CONSTITUTION

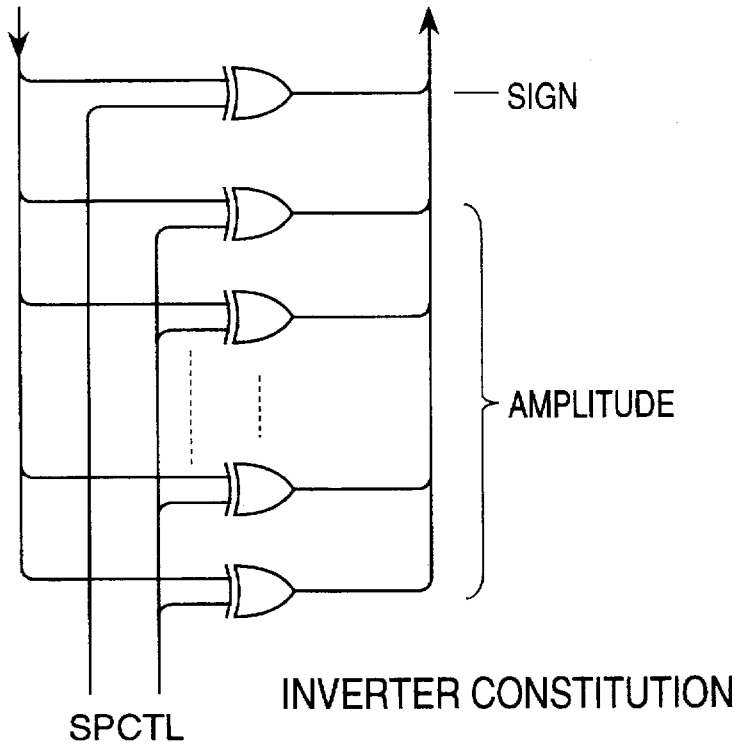
FIG.6
FIG.7A
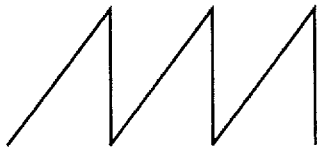
FIG.7B
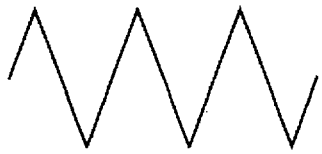
FIG.7C
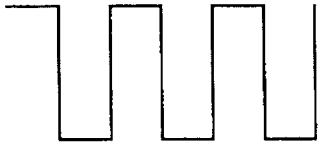

PCM CIRCUIT

TONE SIGNAL GENERATOR HAVING A SOUND EFFECT FUNCTION AND EFFICIENT MEMORY ACCESS

BACKGROUND OF THE INVENTION 1. (Field of the Invention)

The present invention relates to a tone signal generator which can generate tone signals to which various specialized sound effects such as modulation and pitch change are provided, along with musical tones and normal sound effects, and particularly to improvement in access efficiency to a memory in which the tone signals are stored.

2. (Description of the Prior Art)

TV game instruments for entertainment in practical use have tone signal generators. In this instrument, data of tone signals stored in a game cartridge provided by a ROM or a CD - ROM is supplied into an internal RAM of the game instrument, and the data is read according to progress of a game program carried out for generating musical tones with the normal sound effects and the musical tones as background music.

There is filter data for imparting various sound effects to tone signal data to be generated in the RAM, along with the above described data, and a buffer area for imparting the sound effects and other areas for storing process data are also assigned in the RAM. Generally, a CPU and other devices in the TV game instrument frequently access the RAM.

However, the RAM is accessed continuously until a key-off signal (i.e., a note off signal) is inputted, even though the tone signal being generated becomes the lowest level such that no sound is to be substantially heard. The access is apparently unnecessary, thereby causing useless power consumption.

In order to solve the problem, programmers have made a program so that the key-off signal is generated during the tone signal generation. However, such program has increased loads of programming by the programmer.

Further, the tone signal generator usually is provided with a generator for generating envelope wave data which is imparted to the tone signal data read from the RAM. FIG. 15 shows an example of the tone signal data, i.e., musical tone signal data, and the envelope wave data (EG data). The tone signal data includes attack data arranged in an attack part of the tone signal data, and loop data arranged in the following part. The EG data is divided, as shown in FIG. 15, into four phases, A: attack phase, D: decay phase, S: sustain phase (or D2: second decay phase), and, R: release phase. When the tone signal data is read, the EG data is supplied to the tone signal data. In FIG. 15, the loop data is arranged between a loop start address LSA and a loop end address LEA, and when the read address reaches the LEA, the read address returns to the LSA, thereby the read address is looped between the LSA and the LEA.

In the above mentioned tone signal generator, if a pitch is changed, a read address changing width of the tone signal data is changed. That is, if the pitch is changed high, the read address changing width is changed large, and if the pitch is changed low, the read address changing width is changed small.

However, since a generation speed of the EG data is constant, if the read address changing width is changed according to the pitch changing, the phase change timing from the attack phase to the decay phase in the EG data is mismatched with the phase timing from the attack data to the loop data in the tone signal data. Therefore, a proper tone signal can't be generated.

In order to solve the problem, a prior tone signal generator is provided with a key scaling way in which a gradient of the attack phase is changed in response to the pitch changing. However, in the key scaling way, it is difficult to keep precise phase matching between the attack phase in the EG data and the attack data in the tone signal data, and to simplify a structure for changing a shape of the EG data.

SUMMARY OF THE INVENTION

It is therefore an object of the present invention to provide a tone signal generator in which power consumption is minimized.

It is another object of the present invention to provide a tone signal generator in which memory access is more efficient.

It is further object of the present invention to provide a tone signal generator which is capable of precisely matching the phase timing of the EG data and the tone signal data.

In accordance with the present invention, an embodiment of it comprises memory means for storing tone signal data, parameter generation means for generating parameter data, tone signal data generation means for generating the tone signal data by reading it from the memory means, according to the parameter data generated by the parameter generation means, level monitor means for monitoring a level of the tone signal data generated by the tone signal data generation means, and access control means for inhibiting access of the tone signal generation means to the memory means when the level monitor means detects that the level of the tone signal data monitored by the level monitor means is less than a specified value.

In the above structure, because the access control means inhibits the access of the tone signal generation means when the level of the tone signal data reaches the specified value, any other devices, such as a cpu, can access to the memory means in place of the tone signal generation means. Thereby, the process to the tone signal data substantially released can be cancelled, and the power consumption in the tone generation can be minimized.

Another embodiment of the present invention further comprises phase change control means for changing a generating phase of envelope data from an attack phase to the following phase, when a read address in the attack phase of the tone signal data reaches an end address. This configuration allows the phase timing of the envelope data and the tone signal data to be precisely matched.

BRIEF DESCRIPTION OF THE DRAWINGS

FIG. 6 illustrates a structure of an inverter in the PCM circuit.

FIG. 7 shows an example of a wave for modulation, which is stored in the DRAM.

DESCRIPTION OF THE PREFERRED EMBODIMENT

Figure 1:
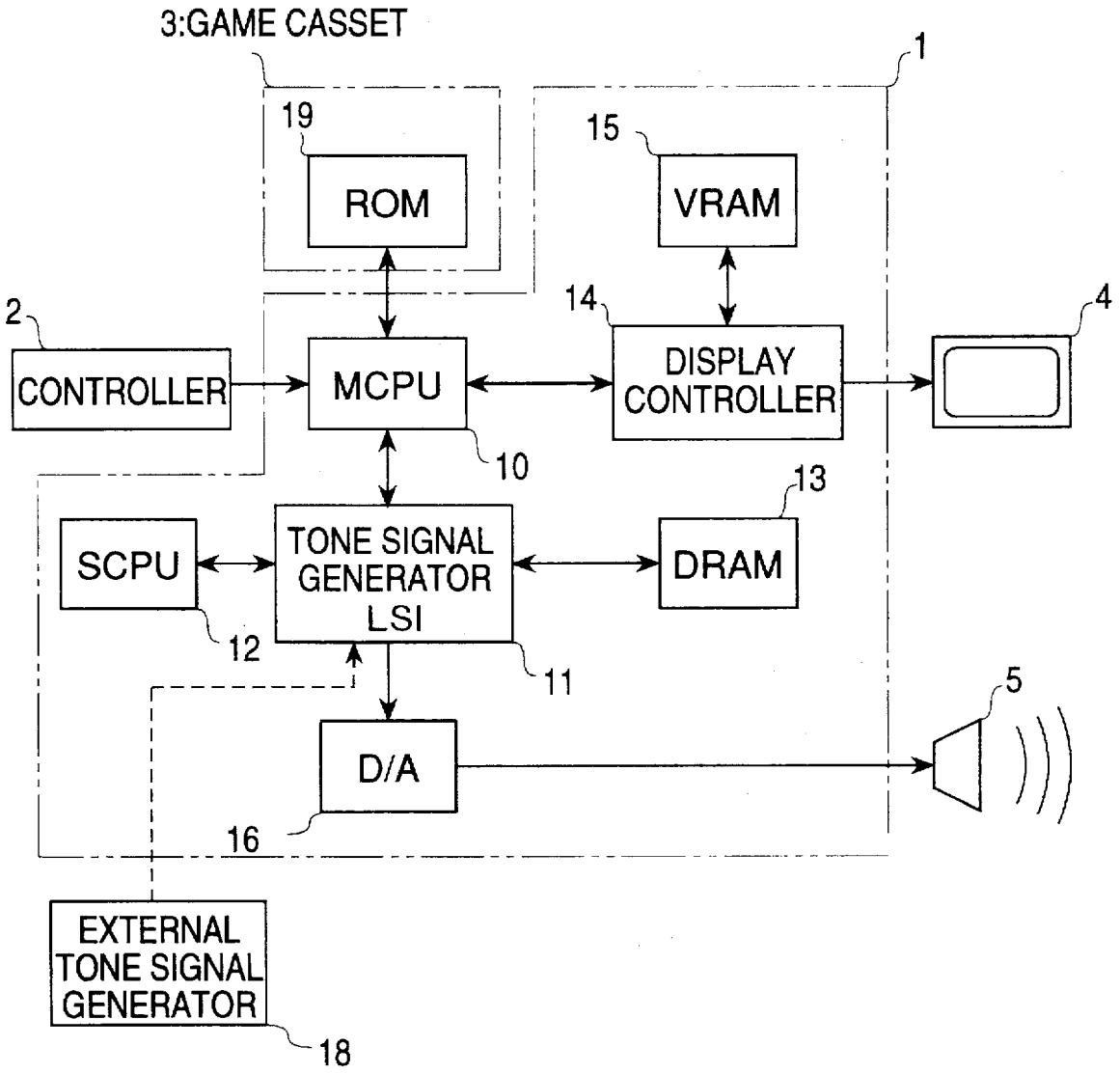
FIG. 1 is a block diagram of a TV game instrument, to which a tone signal generator LSI is applied, embodying the present invention.

FIG. 1 is a block diagram of a TV game instrument, to which a tone signal generator LSI is applied, embodying the present invention.

A display 4 and a speaker 5 are connected to a game instrument 1. The display 4 and the speaker 5 can be used as ones installed into a normal TV receiver. To the game instrument 1, a game cartridge 3 having a ROM 19 in which a game program is stored and a controller 2 for a player to play a game are also connected. The controller 2 is connected to the game instrument 1 through a cable or the like, and the game cartridge 3 is set into a slot mounted in the game instrument 1.

The game instrument 1 is equipped with a main CPU (MCPU) 10 which controls a whole program of the game progress. To the MCPU 10, the controller 2, the ROM 19 mounted into the game cartridge 3, a display controller 14 for controlling the display 4 and a tone signal generator LSI 11, for generating tone signals, such as musical tone signals, with sound effects and musical tones as background music, are connected. A sound CPU (SCPU) 12, a DRAM 13 in which a program for the SCPU 12 and PCM wave data are stored, and a D/A converter 16, for converting generated musical tone data into analog musical tone signals, are connected to the tone signal generator LSI 11. The speaker 5 is connected to the D/A converter 16. The tone signal generator LSI 11 is provided with an external input terminal into which digital tone data can be inputted from an external tone signal generator 18. A VRAM 15 in which screen display data is stored and the display 4 are connected to the display controller 14.

When the power turns on after the game cartridge 3 is set into the game instrument, the MCPU 10 reads specified screen data and sends it to the display controller 14. Then, the MCPU 10 writes programs and the PCM wave data in the DRAM 13, for generating the tone signal data with the sound effects and the BGM (Background Music) tone signal data. After that, the game program is started by operation of the controller 2, and the re-writing of the screen data and the generating of the tone signal data with the sound effects and the BGM tone signal data are performed. The progress control of the game program, i.e., re-writing of the screen data, is carried out directly by the MCPU 10. The MCPU 10 gives instructions to the SCPU 12 for generating the tone signal data with the sound effects and the BGM tone signal data, and the synthesizing of the real tone signal is carried out by the SCPU 12 on the basis of the program and the PCM wave data written into the DRAM 13.

Figure 2:
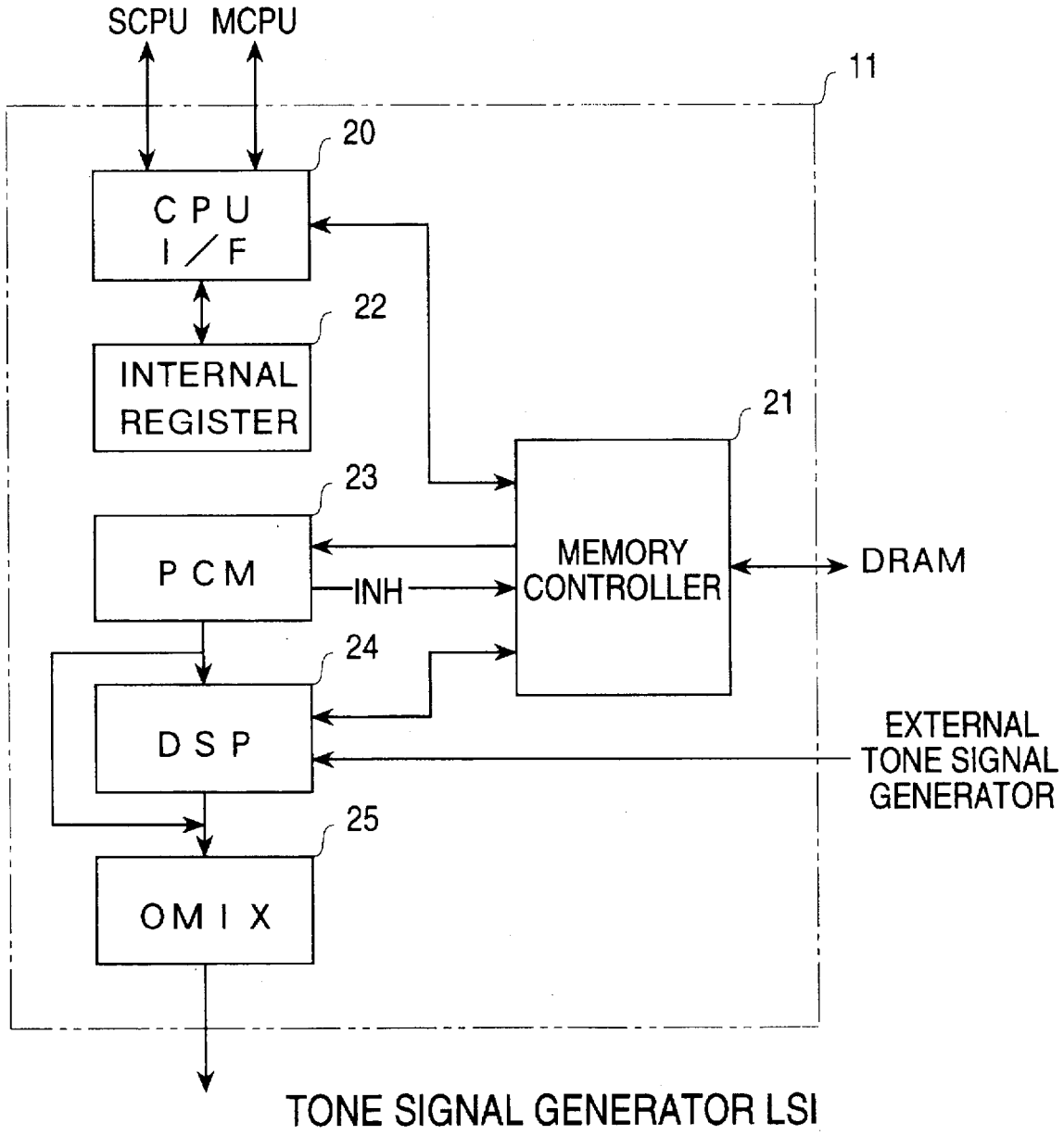
FIG. 2 is a block diagram of the tone signal generator LSI.

FIG. 2 is an internal block diagram of the tone signal generator LSI 11. In the tone signal generator LSI 11, a PCM circuit 23 generates digital low frequency signal data, such as the tone signal data and modulation signal data, when it reads the PCM wave data stored in the DRAM 13 (refer to FIG. 1). As described above, when the game cartridge 3 is set into the slot and the power is turned on, data is streamed from the ROM 19 to the DRAM 13. Therefore, the tone signal data with the sound effects and the BGM tone signal data can be individually different in each game program. To the DRAM 13, the MCPU 10 and the SCPU 12 are connected through a memory controller 21 and a CPU interface 20, and the PCM circuit 23 and a DSP (digital signal processor) 24 mounted into the tone signal generator LSI 11 are connected through the memory controller 21. The MCPU 10, the SCPU 12, the PCM circuit 23 and the DSP 24 are individually accessible to the DRAM 13 through time-sharing. An internal register 22 is connected to the CPU interface 20. Data set into the PCM circuit 23 and the DSP 24, and data for specifying data to set into them by the MCPU 10 and the SCPU 11 are temporarily stored in the internal register 22.

Figure 5:
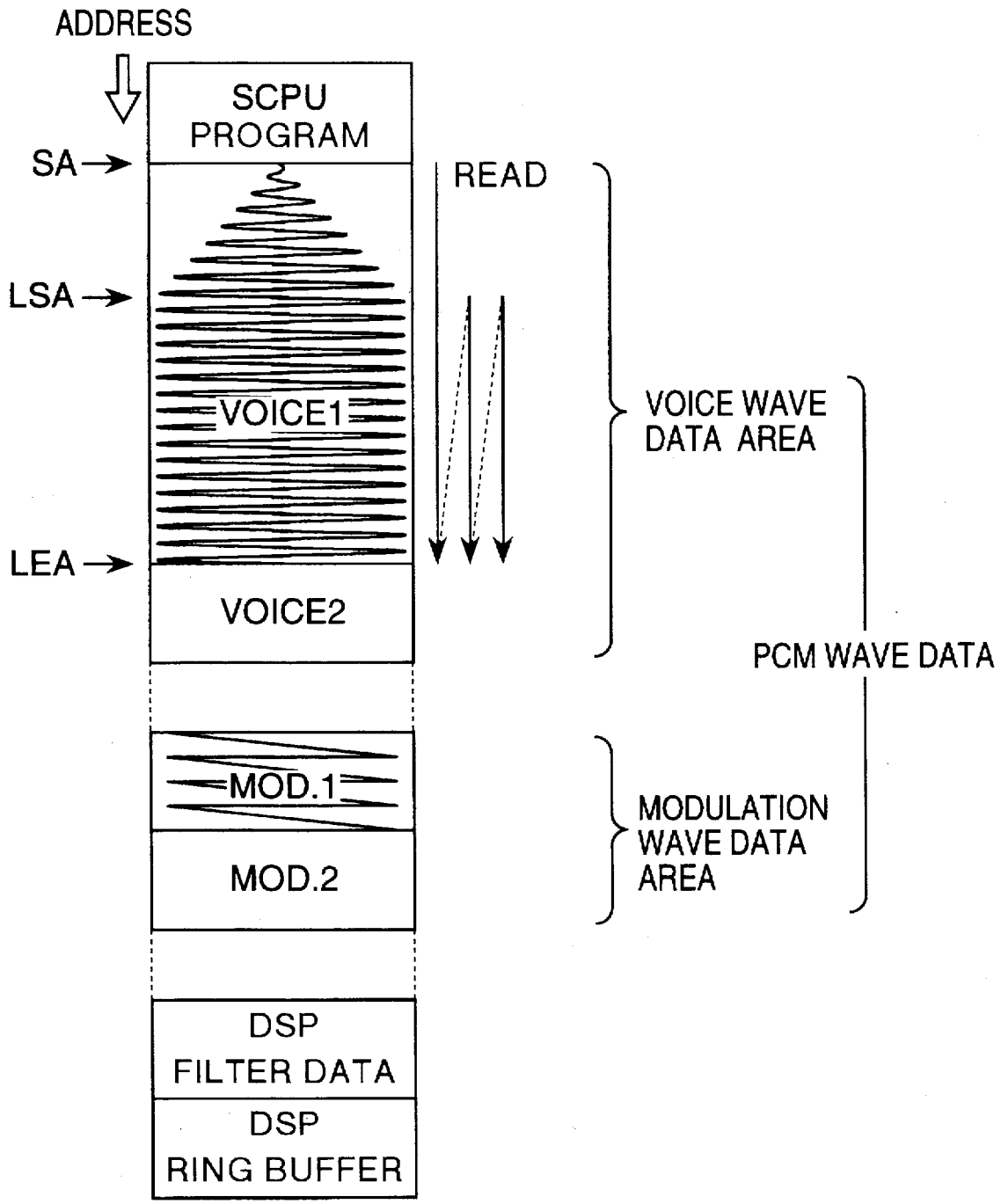
FIG. 5 illustrates an internal structure of a DRAM which is connected to the tone signal generator LSI.

FIG. 5 shows an internal configuration of the DRAM 13.

In the DRAM 13, a SCPU program area for the SCPU 12, a PCM wave data area and a DSP ring buffer are assigned. The PCM wave data includes voice wave data to generate musical tone signals with the sound effects and the BGM tones, and the modulation wave data used as parameters for the sound effects such as the modulation. The plural kinds of voice wave data and the modulation wave data exist and are stored for each data in the DRAM 13. The DSP ring buffer area is used to delay the tone signal data to thereby effect the filtering and the modulating or the like in the DSP 24's process.

As the voice wave data, sampled data of the tone signals with the sound effects or of natural instrument's tone signals is generally used. Such tone signals keep generating tones for a long time, so that the voice wave data comprises start address data SA, and the loop start address data LSA and the loop end address data LEA to read repeatedly. First, the SA is read, and then LSA, LEA are read successively and repeatedly. As a result, the repeated reading between the LSA and the LEA allows generating tone signals for a long time. The modulation wave data is generally simple data, such as sine curve wave data or wave data shown in FIG. 7 (FIGS. 7A, 7B, 7C), because it is for modulating musical tone signals or the like.

The SCPU program, the voice wave data and the modulation data are written by the MCPU 10 when the game cartridge 3 is set into the slot. The SCPU 12 processes the SCPU program based on the MCPU 10's instructions. The PCM circuit 23 reads the PCM wave data based on the SCPU 12's instructions, and generates the digital low frequency signal data. The digital low frequency signal data is used as the tone signal data or the sound effect data. The PCM circuit 23 has thirty-two time sharing channels in which thirty-two kinds of the digital low frequency signal data can be generated individually.

Figure 9:
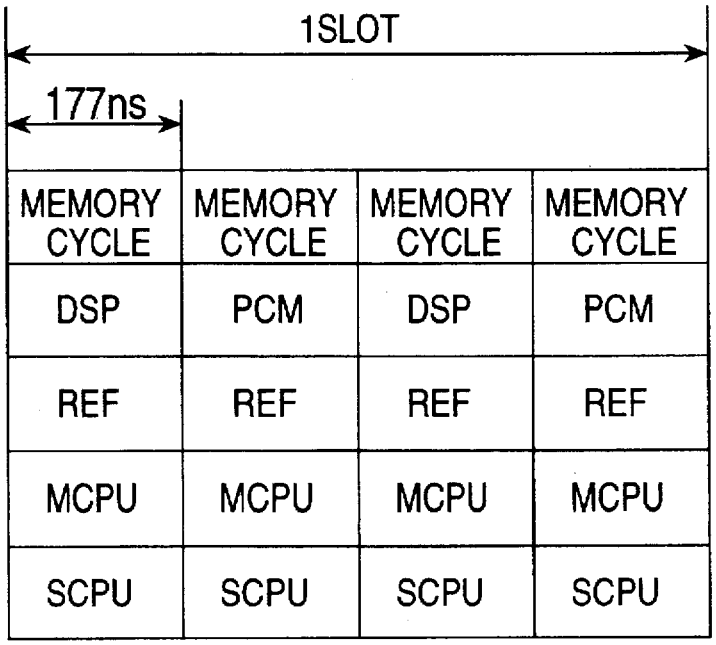
FIG. 9 shows a priority order table of access to the DRAM.

FIG. 9 shows a priority order table of access to the DRAM 13 set in the memory controller 21. The process of the tone signal generator LSI 11 is time-shared by thirty-two time slots in one sampling clock of the PCM wave data. The memory controller 21 is processed by a memory cycle which is generated by division of the sampling clock into one hundred eight. Therefore, four memory cycles correspond to one slot in the tone signal generator. As shown in FIG. 9, four priority orders are set as to the memory access right. In the first priority order, the memory access rights of the DSP 23 and the PCM 24 are assigned alternately, in the second, third and forth priority orders, the memory access rights of a refresh cycle of the DRAM, the MCPU 10, and the SCPU 12 are assigned. Because the DSP 23 and the PCM 24 are required real time processes for the digital low frequency signal data, the highest priority order for them is assigned in the table.

The PCM circuit 23 generates the digital low frequency signal data by reading the PCM wave data according to instructions of the SCPU 12. The digital low frequency signal data is used as the musical tone signal data such as the BGM data or the modulation data. The PCM circuit 23 has thirty-two time-shared channels, thereby being capable of generating thirty-two kinds of the digital low frequency signal data independently. The PCM circuit 23 independently monitors a level of the digital low frequency signal data of every channel, outputting access inhibit signal data INH to the memory controller 21 by judging that no generation of the digital low frequency signal data is necessary any more, when the level becomes less than a specified value. When the INH is received at a channel, the memory controller 21 stops the access to that DRAM 13 as to the channel, and when any memory access is requested from another device or circuit, the memory controller 21 accesses the DRAM 13 in response to the request, thereby, lower items in the memory access priority table are capable of having a chance to access the DRAM 13.

The tone signal data in the digital low frequency signal data that the PCM circuit 23 generates is inputted into the DSP 24 or inputted directly into an out mixing circuit OMIX 25. The modulation signal data is inputted into the DSP 24 for coefficients of the sound effects. Usually, the reading data of the voice wave data area is used as the tone signal data, and the reading data of the modulation wave data area is used as the modulation signal data. However, how to use the signal data is free to thereby generate any desired sound effects. For example, it is possible to use the reading data of the voice wave data area as the modulation signal data. Furthermore, the DSP 24 has an outer external terminal into which other tone signal data or other modulation signal data can be inputted.

The DSP 24 is a circuit for supplying various sound effects, such as modulating, filtering and pitch-changing, to the inputted tone signal data and outputting the obtained data to the output mixing circuit OMIX 25. In order to supply the sound effects to the tone signal data, the modulation signal data which is one of the digital low frequency signal data is inputted into the DSP 24, and the DSP 24 uses the modulation signal data as the coefficients for supplying the sound effects. The tone signal data to which the sound effects is supplied by the DSP 24 is inputted into the output mixing circuit OMIX 25. The OMIX circuit 25 changes each tone signal data in the thirty-two channels to stereo signal data in two channels, and outputs the stereo signal data to the D/A converter circuit 16.

Figure 3:
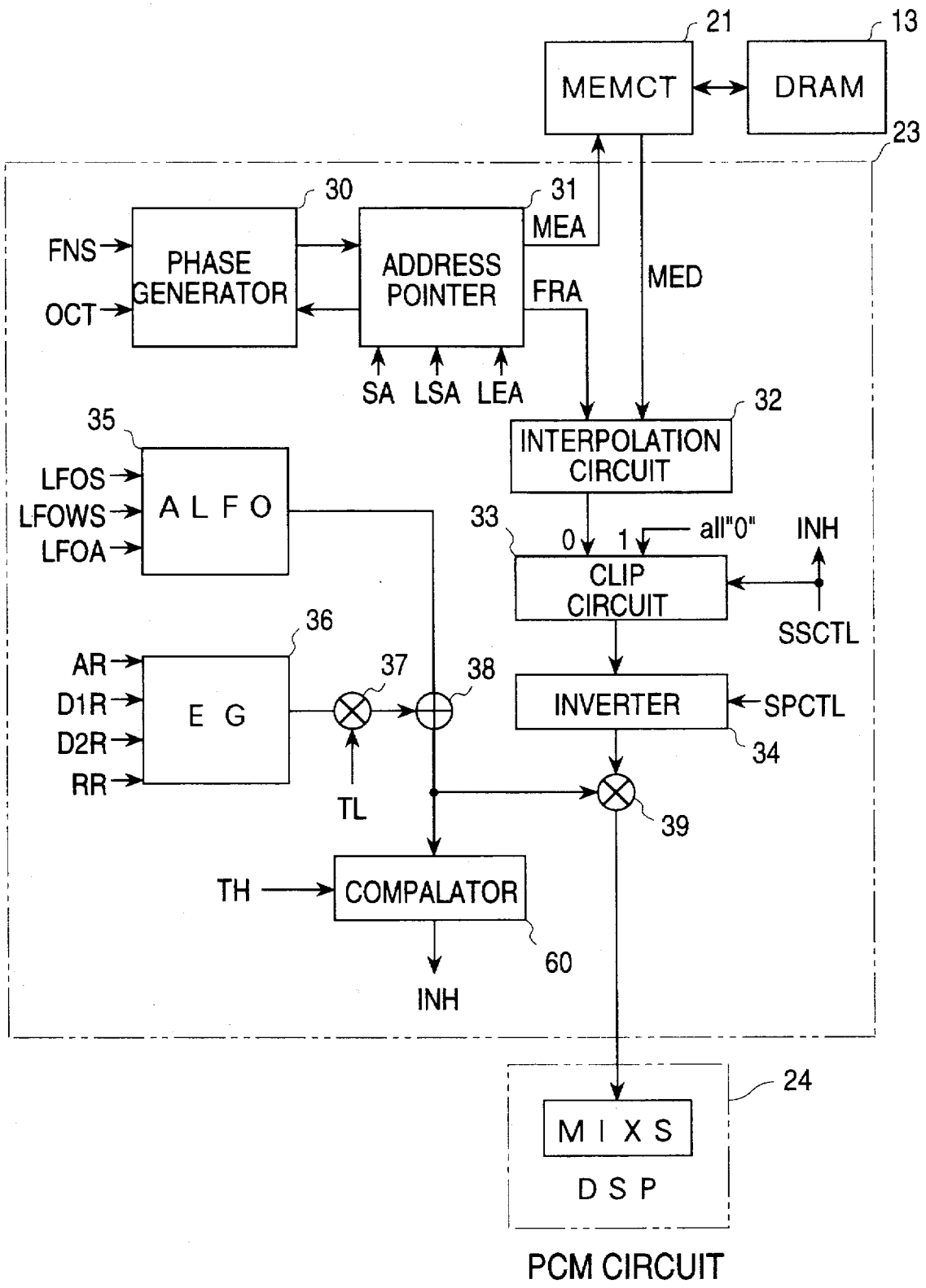
FIG. 3 is a block diagram of a PCM circuit in the tone signal generator LSI.

FIG. 3 shows an internal configuration of the PCM circuit 23.

The PCM circuit 23 comprises a phase generator 30, an address pointer 31, an interpolation circuit 32, a clip circuit 33, an inverter 34, a low frequency wave generator for amplitude modulation (ALFO) 35, an envelope generator (EG) 36, a multiplying circuit 37 and an adder 38. The process in the PCM circuit is carried out by the time-shared way of the thirty-two channels.

FNS data, frequency specifying data in an octave, which is corresponding to a tone pitch name and octave data OCT are supplied from the SCPU 12, and the data is set into the phase generator 30. The phase generator 30 generates phase data based on the FNS and the OCT for each specified sampling cycle. The phase data is inputted into the address pointer 31. The start address data SA, the loop start address data LSA and the loop end address data LEA, which specify a set of PCM wave data, are inputted into the address pointer 31 from the SCPU 12. The address pointer 31 decides an incremental amount of an address number according to the phase data inputted from the phrase generator 30, and outputs the address data including a decimal fraction. The decimal fraction data FRA is outputted to the interpolation circuit 32, and two integer addresses MEA between which the FRA is sandwiched are outputted to the DRAM 13 through the memory controller 21.

The first PCM wave data and the second PCM wave data which is next to the first PCM wave data are read from the DRAM 13 according to the two inputted integer addresses MEA. The PCM wave data read from the DRAM 13 is inputted into the interpolation circuit 32 through the memory controller 21. The interpolation circuit 32 interpolates the two inputted PCM wave data according to the FRA inputted from the address pointer 31, and generates the digital low frequency signal data. The interpolation circuit 32 outputs the obtained data to the clip circuit 33. The clip circuit 33 is a selector which changes the output between the digital low frequency signal data inputted from the interpolation circuit 32 and all "0" data, selecting either for the output according to select signal data SSCTL inputted from the SCPU 12. If the SSCTL is "0", the digital low frequency signal data inputted from the interpolation circuit 32 is outputted as it is to the inverter 34. If the SSCTL is "1", the all "0" data is outputted to the inverter 34 in place of the digital low frequency signal data. Because the read data from the DRAM 13 to which the address pointer 31 accesses becomes invalid when the SSCTTL is "1", the SSCTL is supplied to the memory controller as an inhibit data to work. As a result, when the SSCTL is "1" at a channel, there is no access at the channel to the DRAM 13 to thereby make an allowance of a memory cycle.

The inverter 34, shown in FIG. 6, inverts each bit of the digital low frequency signal data which consists of a plurality of bits (for example, sixteen bits) according to the SPCTL. The SPCTL consists of two bits of data inputted from the SCPU. The digital low frequency signal data and the SPCTL are inputted into two input terminals of the XOR circuit. A higher bit of the SPCTL is inputted into the XOR for a sign bit (the maximum bit) of the digital low frequency signal data, while, a lower bit of the SPCTL is inputted into the XORs for numeral bits (amplitude bits). If the SPCTL is "0" and "0", the inputted digital low frequency signal data is outputted as it is, otherwise, if the SPCTL is "1" and "0", the sign bit of the inputted digital low frequency signal data is only inverted to output. Still more, if the SPCTL is "0" and "1", the numeral bits of the digital low frequency signal data are inverted to output, and if the SPCTL is "1" and "1", all the bits are inverted to output.

The digital low frequency signal data (including direct current signal data) outputted from the inverter 34 is inputted into a multiplying circuit 39. The ALFO 35 and the EG 36 are connected through an adder 38 to the multiplying circuit 39. That is, low frequency signal data generated by the ALFO 35 is inputted into the adder 38, and envelope data generated by the EG 36 is multiplied by total level data TL to output it to the adder 38. The added data at the adder 38 is inputted into the multiplying circuit 39 and a comparator 60. If a normal musical tone signal data is inputted as the digital low frequency signal data, the multiplying circuit 39 processes the signal by the amplitude modulation and the envelope imparting. If the digital low frequency signal data or the envelope data is used as the modulation data at the DSP 24, the digital low frequency signal data is fixed at a specified value and the output data from the adder 38 is inputted into the multiplying circuit 39. If the modulation data for imparting the sound effects is inputted as the digital low frequency signal data, the ALFO 35 and the EG 36 are substantially turned off to output the modulation data as it is. The clip circuit 33 and the inverter 34 are mainly arranged for this purpose.

Therefore, if a programmer wants to directly output the wave data of the ALFO 35 or the EG 36 from the multiplying circuit 39, the SSCTL is set to "1" and the SPCTL is set to "0" and "1", for example. This results in that the output of the clip circuit 33 is fixed to "0, 0 . . . 0", and the output of the inverter 34 is fixed to the maximum value data "0,1 . . . 1". This fixed data is multiplied by the output data of the ALFO 35 or the output data of the EG 36, and therefore the output data of the ALFO 35 or the EG 36 is directly outputted from the multiplying circuit 37.

At the multiplying circuit 39, the following process is carried out.

If the musical tone signal data is inputted into the multiplying circuit 39 as the digital low frequency signal data, and the low frequency wave signal data is inputted from the ALFO 35 into the circuit 39, the inputted musical tone signal data is modulated by the low frequency wave signal data.

If the musical tone signal data is inputted into the multiplying circuit 39 as the digital low frequency signal data, and the envelope wave data is inputted from the EG 36 into the circuit 39, the inputted musical tone signal data is multiplied by the envelope wave data to provide the changing of the tone volume according to the envelope wave data.

If the low frequency signal data or the envelope wave data is used directly for the modulation at the DSP 24, the digital low frequency signal data is fixed (changed) to a specified value at the clip circuit 33, and the low frequency signal data or the envelope wave data is outputted directly from the multiplying circuit 39.

If the digital low frequency signal data is used as the modulation data for providing the tone signal data with the sound effects, the ALFO 35 and the EG 36 are substantially set to "OFF" to output the modulation data directly from the multiplying circuit 39.

Figure 8:
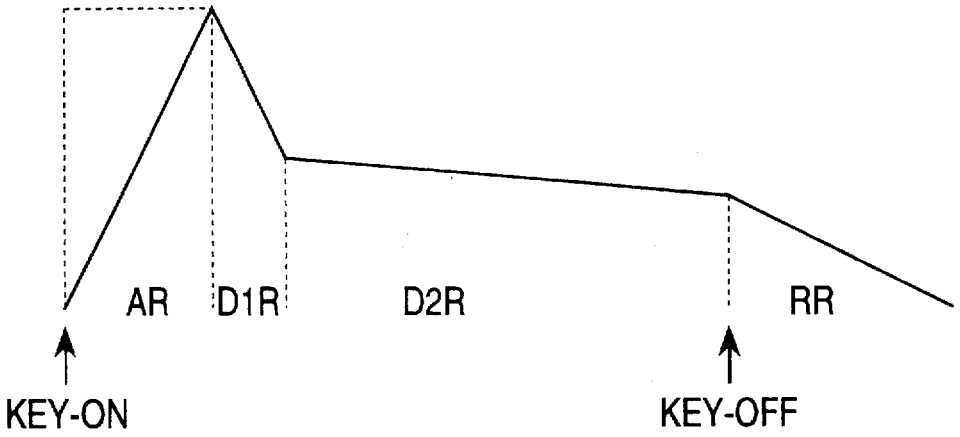
FIG. 8 shows an example of an envelope which is generated by the PCM circuit.

The ALFO 35 and the EG 36 are arranged by a well known circuit. The ALFO 35 generates the sine curve wave data or the low frequency wave data as shown in FIGS. 7A to 7C, for example, according to frequency data LFOS, wave specifying data LFOWS, and influence data (amplitude data) LFOA supplied by the SCPU 12. The EG 36 generates the envelope wave data as shown in FIG. 8, according to attack rate data AR, first decay rate data D1R, second decay rate data D2R, and release rate data RR supplied by the SCPU 12. The PCM wave data may include the wave data in which an envelope wave is provided to only an attack part, a part from the start address SA to the loop start address LSA. If such PCM wave data is read, the maximum value data is outputted from the EG 36 during the attack part reading (refer to the broken line in FIG. 8).

At the comparator 60, the input data from the adder 38 is compared with threshold data TH. If the input data from the adder 38 is smaller than the TH in a processed channel, the INH is outputted to the memory controller 21 since the digital low frequency signal data in the processed channel is not necessary generate, thereby a memory access of the processed channel being inhibited to free the memory cycle. In this example, the value of the TH is set, for example, to the minimum decay value of the envelope data.

It is possible to use a multiplying circuit in place of the adder 38.

Figure 4:
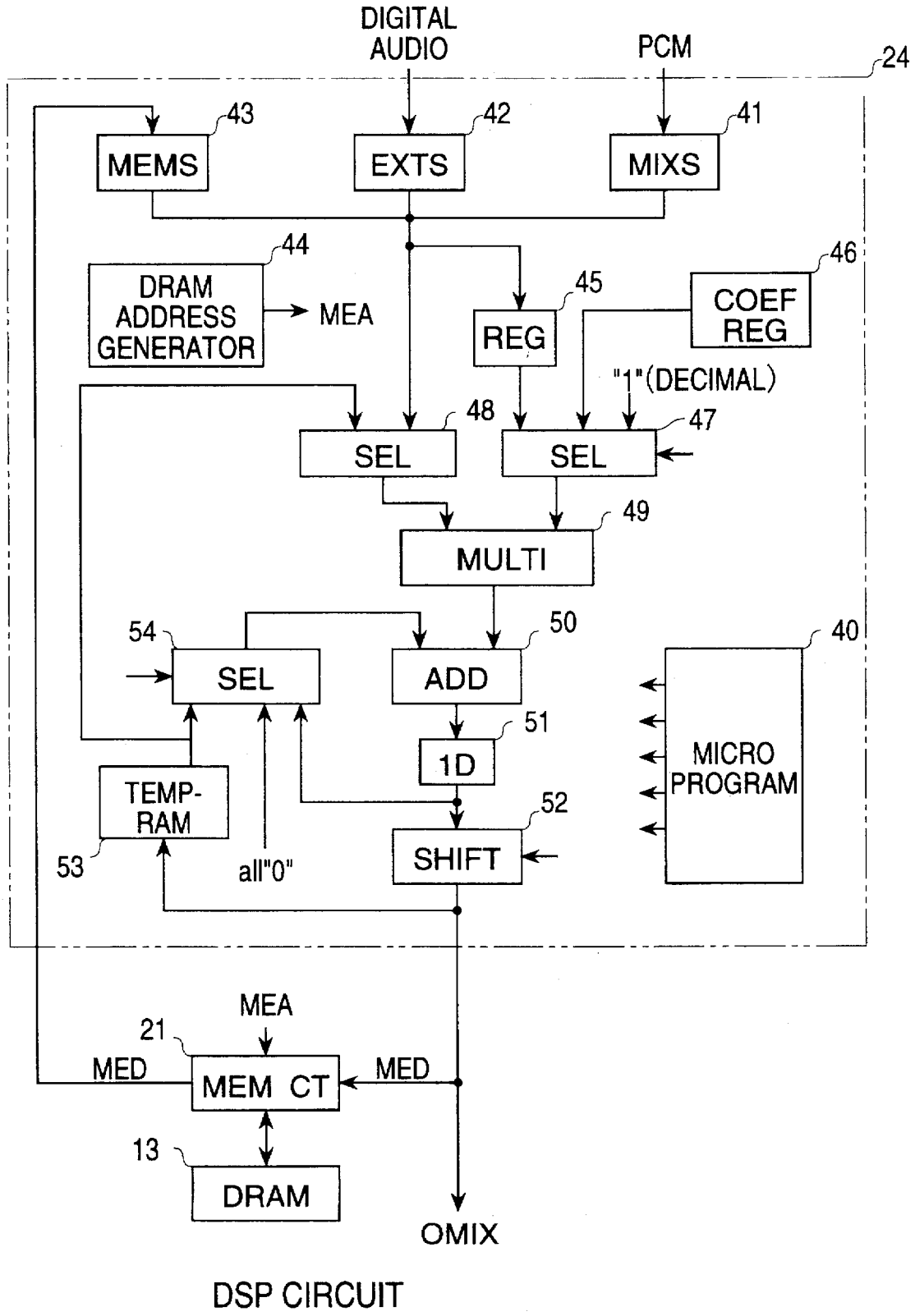
FIG. 4 is a block diagram of a DSP in the tone signal generator LSI.

FIG. 4 is a block diagram of the DSP 24 which is built into the tone signal generator LSI 11.

In the DSP 24, the digital low frequency signal data for the 16 channels inputted from the PCM circuit 23 can be handled at the same time, and also the digital low frequency signal data for the 2 channels inputted from outside can be handled at the same time. The DSP 24 processes the inputted data by delaying or filtering if the data is the tone signal data, and outputs thus processed data to the output mixing circuit 25. Furthermore, the DSP 24 can process the digital low frequency signal data as the modulation data, i. e., the coefficient data for providing the sound effects, to any tone signal data.

In this embodiment, the PCM circuit 23 has 32 channels while the DSP 24 has 16 channels. This difference in the number of channels may be cancelled by that a part of the output of the DSP 24 is directly outputted to the output mixing circuit 25.

The DSP24 has a MIXS register 41 of 16 words as a register for storing the inputted digital low frequency signal data from the PCM circuit 23. The DSP 24 has also an EXTS register 42 of 2 words as a register for storing the inputted digital low frequency signal data from an external tone generator 18. The DSP 24 also has a MEMS register 43 of 32 words as a register for temporarily storing the data which is read from a ring buffer of the DRAM 13, to process it again by the DSP 24. These registers MIXS 41, EXTS 42, and MEMS 43 are connected to both a register 45 and a selector 48. The register 45 is a circuit for temporarily storing the coefficient data (modulation data) to input it to a multiplying circuit 49 in synchronization with the timing of the tone signal data to be modulated. The selector 48 is a circuit for selecting the tone signal data to be inputted to the multiplying circuit 49. The combination of the input data to the register 45 and the selector 48 allows the process of the DSP 24 to provide the tone signal data with various sound effects.

The DSP 24 processes repeatedly the 256 steps of the program stored in a micro program memory 40. The program specifies any desired register, from among the registers, MEMS 43, EXTS 42 and MIXS 41, which outputs the data to the register 45 or the selector 48.

A DRAM address generator 44 generates address data to access the ring buffer in the DRAM 13, and outputs it to the memory controller 21. The memory controller 21 access the DRAM 13 by this address data to write/read data to be delayed in the ring buffer. The multiplying circuit 49, as described above, multiplies the tone signal data by the coefficient data to impart various sound effects to the tone signal data. The tone signal data to be modulated is chosen from among the data of the registers, MIXS 41, EXTS 42, MEMS 43 and a TEMP-RAM 53. The TEMP-RAM 53 is a temporary RAM register to temporarily store the data once processed by this DSP 24, resulting in short delay. The temporarily stored data is inputted for re-processing into the selector 48 or another selector 54 by a feedback circuit. The control of the selectors and any other registers is performed by the program. The coefficient data to be inputted into the multiplying circuit 49 is chosen by a selector 47. The register 45 and a coefficient register 46 in which some fixed coefficient data is stored are connected to the selector 47, and the fixed data "000 . . . 1" (i.e., "1" of decimal numeral) is inputted into the selector 47. The selector 47 chooses one data from among these data as the coefficient data to be used, and outputs it to the multiplying circuit 49. If the register 45 is chosen, the digital low frequency signal data inputted from the PCM circuit 23 may be imparted, as the modulation data for the sound effects, to the tone signal data inputted from the selector 48. If the coefficient register 46 is chosen in place of the register 45, the modulation to the tone signal data is carried out by the fixed coefficient data stored in the coefficient register 46. If the fixed data, "000 . . . 1", is chosen in place of these registers, the inputted tone signal data is outputted to the next circuit (an adder 50) as it is.

The tone signal data outputted from the multiplying circuit 49 is inputted into the adder 50. The adder 50 adds the specified coefficient data for adding to the tone signal data, the added data being outputted from this DSP 24 through a 1 clock delay circuit 51 and a shift circuit 52. The specified coefficient data for adding is chosen by the selector 54 from among the output of the 1 clock delay circuit 51, the output of the TEMP-RAM 53, and the fixed all "0" data. The 1 clock delay circuit 51 is a circuit for delaying the added data for one sampling clock, and the shift circuit 52 is for shifting the delayed data by a number of specified figures which is set externally. The TEMP-RAM 53 delays for a moment the output data of the shift circuit 52 by temporarily storing the data. As to the delay of data, the ring buffer's one (from 10 ms to 1 s) in the DRAM 13 is longer than the TEMP-RAM's one.

In the DSP 24, various sound effects can be imparted to the tone signal data by the delay of the ring buffer, the 1 bit delay circuit 51, and the TEMP-RAM 53, by the multiplying of the multiplying circuit 49, and by the adding of the adder 50. Furthermore, it is optional to select the input data to the multiplying circuit 49, as the tone signal data, from among the digital low frequency signal data, the digital signal data from the external tone signal generator 18, and the delayed digital signal data outputted from the ring buffer in the DRAM 13. Also, it is arbitrary to select the coefficient data for multiplying from among the digital low frequency signal data, the digital signal data from the external tone signal generator 18, the delayed digital signal data outputted from the ring buffer in the DRAM 13, and the fixed coefficient data from the coefficient register 46. This configuration of the DSP 24 allows the sound effects to be much wider, deeper, and more optional.

Figure 10:
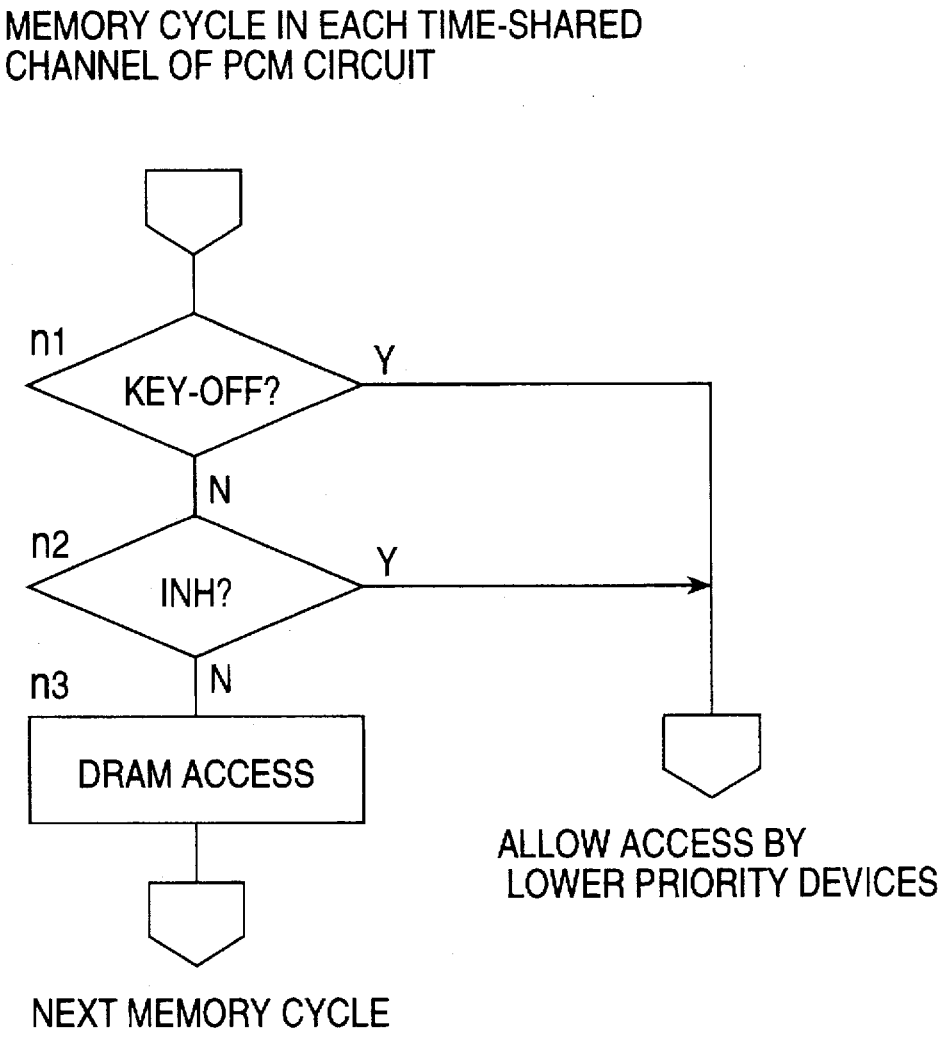
FIG. 10 is a flow chart showing a process of a memory controller.

FIG. 10 is a flow chart showing an access control process of the memory controller. This process belongs to the first priority order of the table shown in FIG. 9. At step n1, the tone generation channel to be accessed is in key-off. If it is in key-off, the lower items in the table become possible to access to any memory. At step n2, whether or not the INH has been inputted from the PCM circuit 23 is judged. With INH="yes", the lower items in the table become possible to access to any memory, even though the channel is not in key-off. The DRAM can be accessed to read the PCM wave data only when the channel is not in key-off and no INH is inputted (n3).

As described above, in this embodiment, the PCM circuit 23 outputs the INH, when the level of the envelope data or the low frequency signal data, for modulation to be multiplied by the digital low frequency signal data, becomes smaller than the specified threshold data TH, and when the SSCTL becomes "1" to thereby fix the digital low frequency signal data, the PCM circuit 23 outputs the memory access inhibit data INH, and therefore, the memory controller 21 inhibits the access to the DRAM 13 in the tone generation channel in response to the INH to free the memory cycle in which any other lower priority items, for example the SCPU 12 or the MCPU 10, can access.

Another embodiment of the present invention is described as follows, referring to FIGS. 11 to 14.

Figure 11:
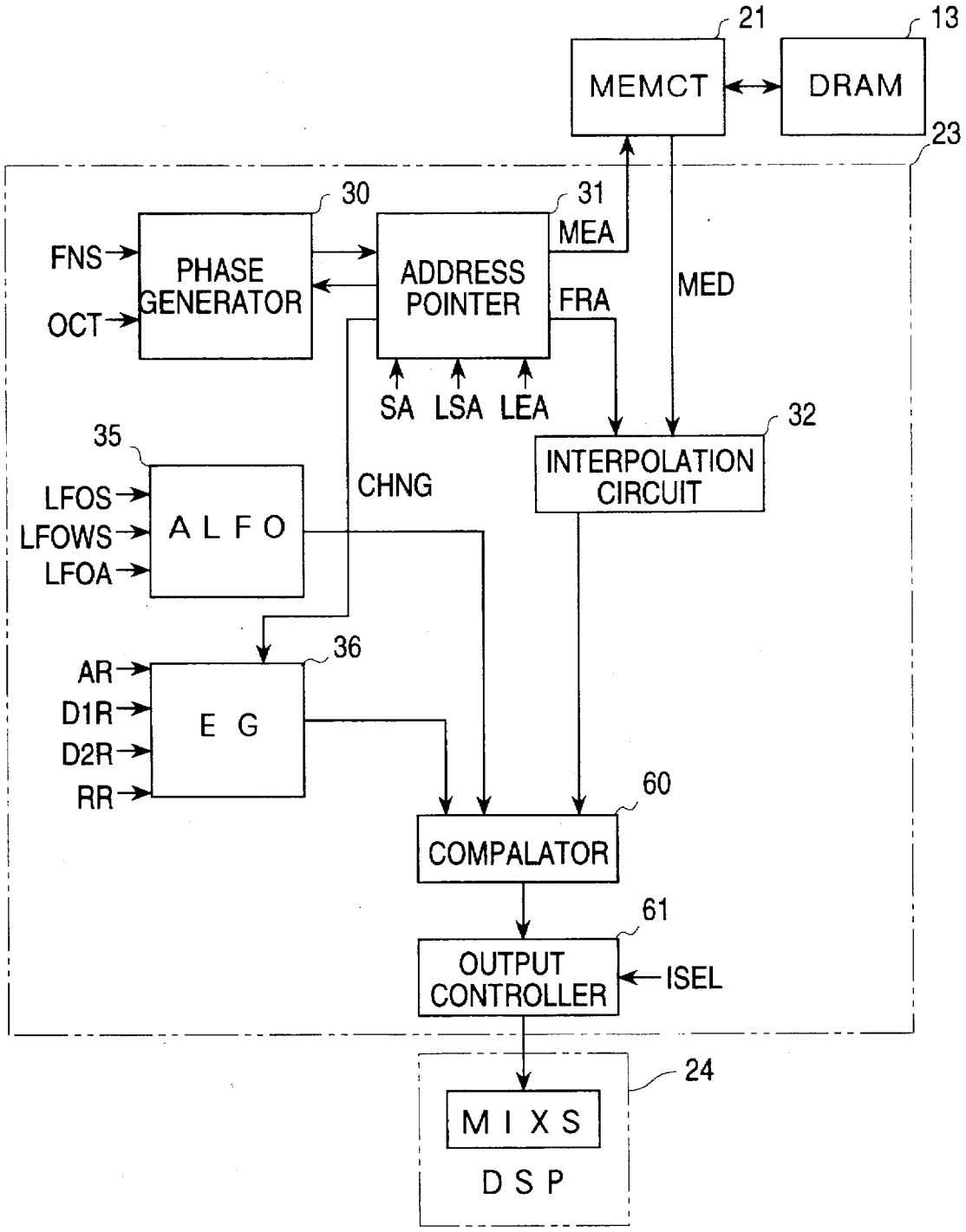
FIG. 11 shows an internal structure of another type of PCM circuit.

FIG. 11 shows an internal structure of another type of PCM circuit 23.

The PCM circuit 23 comprises the phase generator 30, the address pointer 31, the interpolation circuit 32, the low frequency wave generator for amplitude modulation (ALFO) 35, the envelope generator (EG) 36, the multiplying circuit 60 and the output controller 61. The process in the PCM circuit 23 is carried out by the time-shared way of the thirty-two channels.

FNS data, frequency specifying data in an octave, which is corresponding to a tone pitch name and octave data OCT are supplied from the SCPU 12, and the data is set into the phase generator 30. The phase generator 30 generates phase data based on the FNS and the OCT for each specified sampling cycle. The phase data is inputted into the address pointer 31. The start address data SA, the loop start address data LSA and the loop end address data LEA, which specify a set of PCM wave data, are inputted into the address pointer 31 from the SCPU 12. The address pointer 31 decides an incremental amount of an address number according to the phase data inputted from the phase generator 30, and outputs the address data including a decimal fraction. The decimal fraction data FRA is outputted to the interpolation circuit 32, and two integer addresses MEA between which the FRA is sandwiched are outputted to the DRAM 13 through the memory controller 21.

The first PCM wave data and the second PCM wave data which is next to the first PCM wave data are read from the DRAM 13 according to the two inputted integer addresses MEA. The PCM wave data read from the DRAM 13 is inputted into the interpolation circuit 32 through the memory controller 21. The interpolation circuit 32 interpolates the two inputted PCM wave data according to the FRA inputted from the address pointer 31, and generates the digital low frequency signal data.

The output of the interpolation circuit 32 is inputted into the multiplying circuit 60 to which the low frequency signal data such as rectangle wave data and saw tooth wave data from the ALFO 35 and the EG 36, or the EG data shown in FIG. 8 is supplied. The multiplying circuit 60 processes multiplying for each one word which is a process unit in each time slot to output it to the output controller 38. The digital low frequency signal data which is the output of the interpolation circuit 32 is controlled in envelope by the output data of the ALFO 35 and the EG 36, therefore being outputted to the DSP 24 through the output controller 38.

The DSP 24 operates on the controlled data by filtering, and outputting it to the D/A converter 16 for outputting musical tone signals.

The PCM circuit 23 is provided with a control line for outputting data CHNG from the address pointer to the EG 36. The CHNG is data which is generated when the address pointer 31 detects a read end point of the attack phase in the PCM wave data. As described later, the EG 36 receives the CHNG to control the EG data so that the EG data is changed from the attack phase to the following phase.

Figure 12:
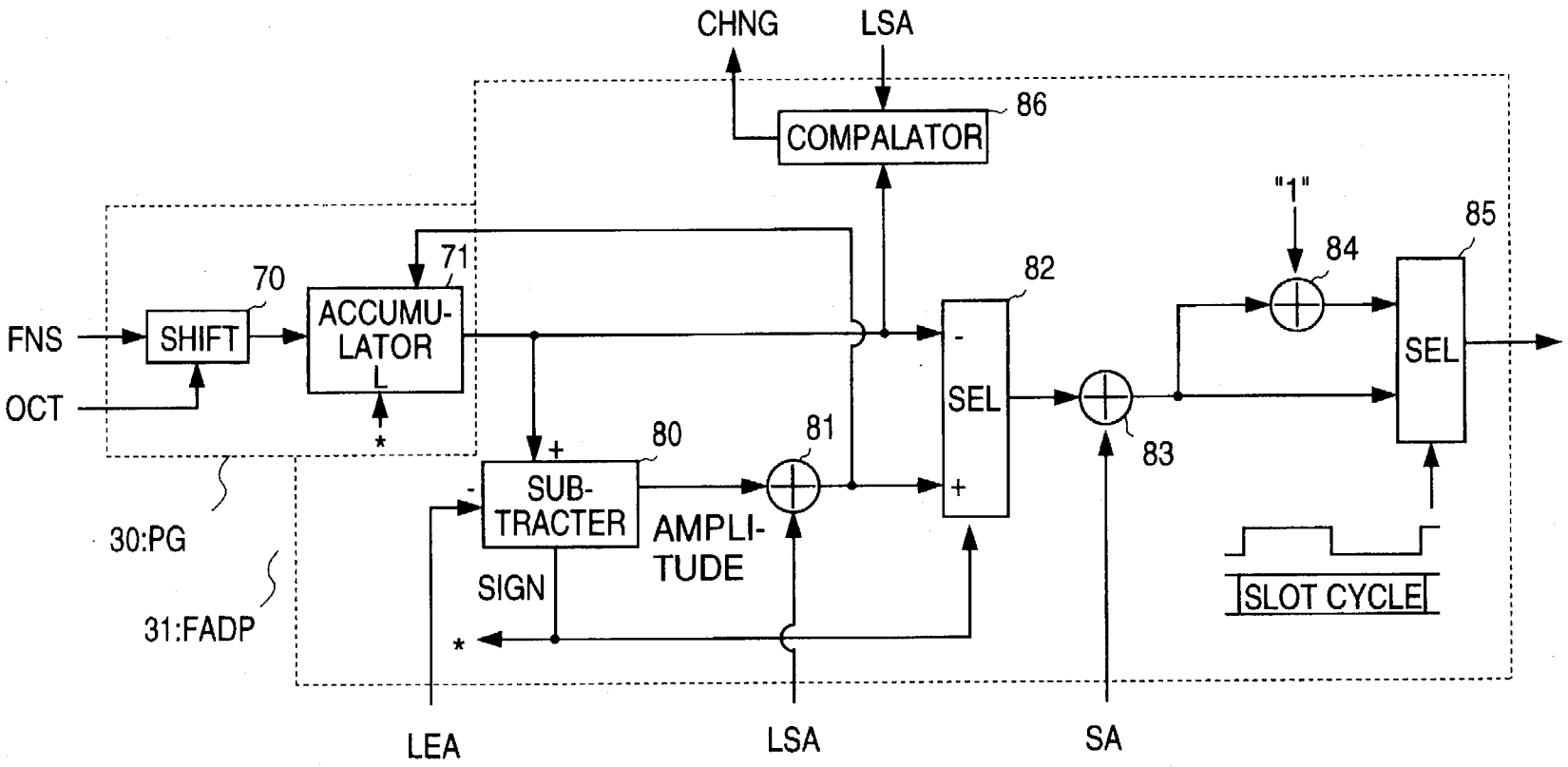
FIG. 12 shows a block diagram of a phase generator and an address pointer arranged in the PCM circuit.

FIG. 12 is a block diagram of the phase generator 30 and the address pointer 31 arranged in the PCM circuit 23.

The phase generator 30 is provided with a shift circuit 70 and a accumulator 71. The shift circuit 70 generates frequency data by shifting the FNS data enough for the OCT data. The frequency data is inputted into the accumulator 71 to generate phase data, i.e., relative address data (as the start address SA is "0") to read the PCM wave data.

The address pointer 31 is equipped with a subtracter 80 for subtracting the loop end address LEA of the loop data area (refer to FIG. 5) from the relative address data outputted from the accumulator 71, an adder 81 for adding the output data other than the sign bit of the subtracter 80 to the loop start address data LSA, a selector for selecting the added data by the adder 81 or the output of the accumulator 71, an adder 83 for adding the output data of the selector 82 to the start address data SA which is absolute address data, an adder 84 and an selector 85 associated with the interpolation circuit 32 for calculating the decimal fraction data FRA, and a comparator 86 for comparing the relative address data with the LSA. The SA is given as the absolute address, the LSA and the LEA being given as the relative address to the SA.

The address pointer's process is described referring to the addresses in the voice wave data storage area shown in FIG. 5.

The subtracter 80 subtracts the LEA from the relative address of the accumulator 71, so that the sign bit of the subtracter 80's output is a minus at the beginning of the PCM wave data reading. The selector 82 selects the output of the accumulator 71 to output it to the adder 83, when the subtracter 80's output is a minus. Therefore, at the beginning of the PCM wave data reading, the output of the accumulator 71 is outputted to the adder 83 as it is, and then the output of the accumulator 71 is added to the SA which is the absolute start address to output the added address as actual address of the DRAM 13. The added result by the adder 83 is divided into the integer address data MEA and the decimal fraction address data FRA. The MEA is outputted through the selector 85 at the first cycle in one slot as it is, and is added to "1" by the adder 84 at the latter cycle in the same slot to output the added data through the selector 85. The two sets of the MEA are provided to the memory controller 21 in one slot, so that the memory controller 21 receives the two sets of the MEA in one slot, outputting two sets of data corresponding the MEA to the interpolation circuit 32 for interpolation as to the FRA.

When the sign bit of the output of the subtracter 80 changes to a plus, the plus data switches the selector 82, and the accumulator 71 loads the output of the adder 81 because a sign terminal of the subtracter 80 is connected to a load terminal of the accumulator 71. At that timing, the output data other than the sign bit is nearly equal to "0", so that LSA' data which is slightly larger than the LSA is loaded into the accumulator 71. When the LSA' is loaded into the accumulator 71, the output sign bit of the subtracter 80 becomes a minus again. Then, the selector 82 selects the output of the accumulator 71 again. Therefore, when the relative address of the accumulator output exceeds the LEA, the selector 82 selects the output of the adder 81 to then output the LSA', and immediately after that, selects again the output of the accumulator 71, thereby an increment amount from the LSA' being outputted to the adder 83. As a result, repeated reading, as shown by an arrow in FIG. 5, is performed.

The relative address data outputted from the accumulator 71 is compared with the LSA by the comparator 86, and when both of the address data coincide, the CHNG is outputted to the EG 36. The CHNG output timing is a timing that the output of the accumulator 71 reaches the LSA from the SA. In the loop process, when the address returns to the LSA' from the LEA, the relative address data, the output of the accumulator 71, becomes the LSA' which advances slightly larger than the LSA, then no CHNG being generated at the reach timing. As described later, the EG data phase is changed from the attack phase to the following phase when the CHNG is generated.

Figure 13:
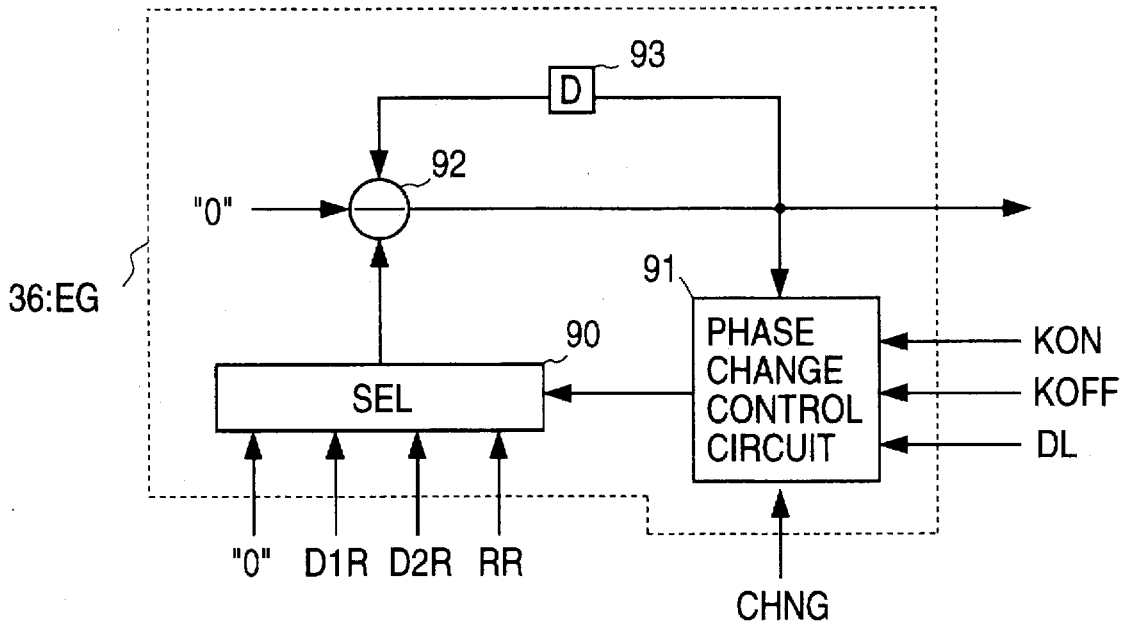
FIG. 13 shows a detailed block diagram of an envelope generator.
Figure 14:
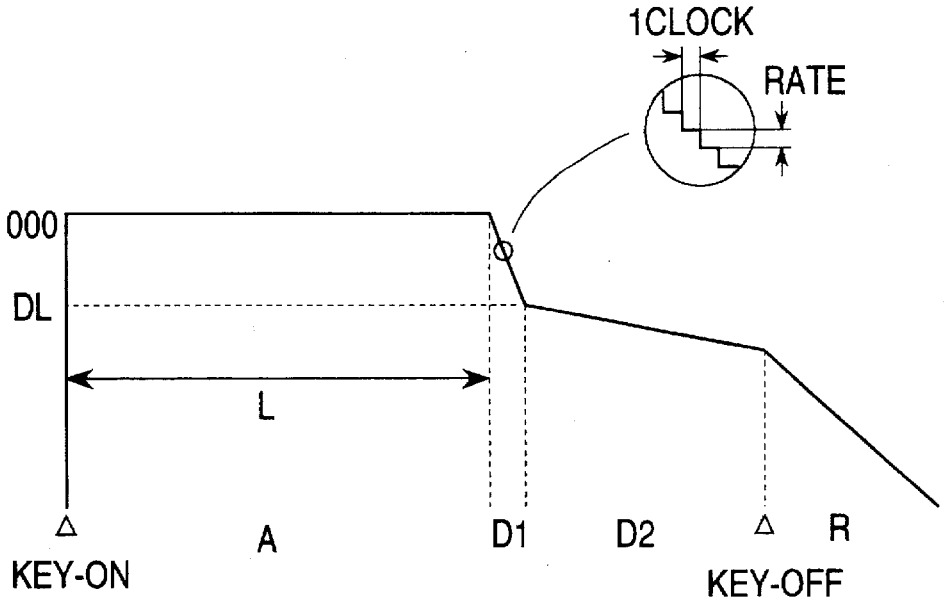
FIG. 14 shows how attack phase lengths are corrected according to the musical tone pitch to be generated.
Figure 15:
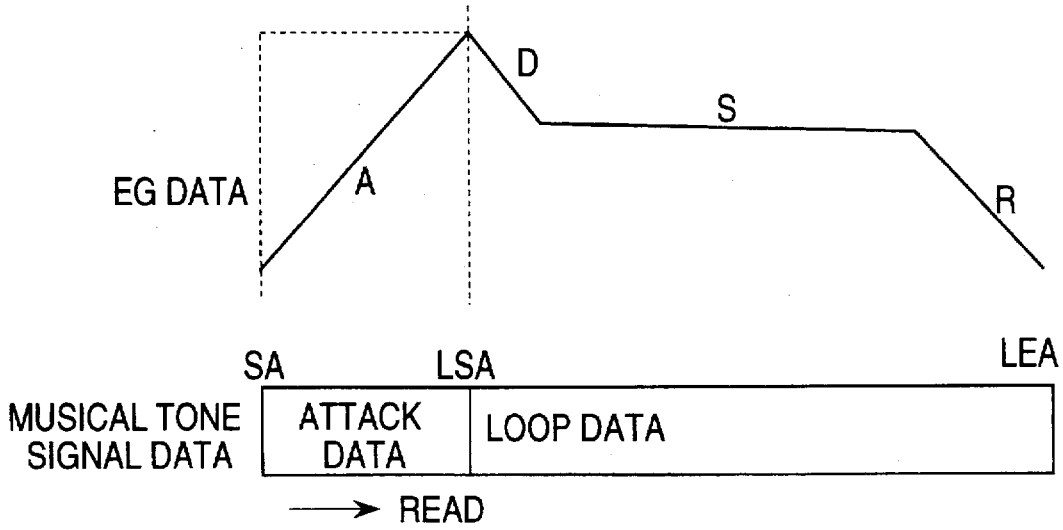
FIG. 15 shows an example of tone signal data and envelope wave data.

FIG. 13 is a detail block diagram of the EG 36. A selector 90 selects rate data from among "0", "D1R", "D2R", and "RR" and outputs it to a subtracter 92 according to an output of a phase change control circuit 91. Each rate data represents a rate change width for each clock. The rate data selected by the selector 90 is used first as subtracting data from "0" at the subtracter 92, and then is used as subtracting data from a one clock delay circuit 93 from the next clock cycle. The output of the subtracter 92 is equal to the output of the EG, being supplied to the phase change control circuit 91 in order to monitor whether the EG data reaches a decay level DL or not. The EG data is also supplied to the delay circuit 93.

In the above mentioned structure, the output of the subtracter 92, i.e., output of the EG 36, decays gradually on the basis of the rate data selected by the selector 90 except the rate being "0". While, the output level of the phase change control circuit 91 is compared with the decay level DL at the timing when the first decay phase changes to the second decay phase in the control circuit 91 to monitor whether both levels coincide or not. If they coincide, the selector 90 is instructed so that the rate data D2R is selected. The decay level DL is set beforehand, not key-on data KON or the like generated by events. The key-on data KON, the key-off data KOFF, and the CHNG from the address pointer 31 are inputted into the phase change control circuit 91. The phase change control circuit 91 instructs the selector 90 so that "0" is selected when it receives the key-on data KON, then so that D1R being selected when it receives the CHNG from the address pointer 31. Furthermore, the circuit 91 instructs the selector 90 so that RR is selected when it receives the key-off data KOFF. The above mentioned control process allows the attack phase of the EG data to be outputted when the KON is inputted first, then the first decay phase D1 to be outputted when the CHNG is inputted from the address pointer 31, further the second decay phase to be outputted when the EG data level reaches the DL, still more the release phase R to be outputted when the KOFF is inputted.

In the above described control, the timing when the CHNG is outputted from the address pointer 31 is when the comparator 86 detects the coincidence of the relative address data from the accumulator 71 and the LSA. Therefore, because the CHNG is generated when the read address of the PCM wave data reaches the LSA, the EG data generating phase is moved to the first decay phase D1 from the attack phase A in the EG 36, so that the PCM wave data reading and the attack phase generating of the EG data are interlocked. That is, the attack phase length L in FIG. 14 interlocks with the attack phase length of the PCM wave data to thereby allow the attack phase length L to be precisely expanded and contracted according to the musical tone pitch to be generated.

As described above, the reading end address of the attack phase in the musical tone signal data (the PCM wave data) is detected at the address pointer 31, the CHNG is outputted to the EG 36, and the EG data phase is changed from the attack phase to the following phase in response to the CHNG at the EG 36. As a result, the EG data is precisely interlocked with the musical tone signal data in the attack part to generate the musical tone properly in any pitch changing.

What is claimed is:

1. A tone signal generator comprising:

memory means for storing tone signal data;

parameter generation means for generating parameter data;

tone signal data generation means for generating the tone signal data by reading it from the memory means, according to the parameter data generated by the parameter generation means;

level monitor means for monitoring a level of the tone signal data generated by the tone signal data generation means; and access control means for inhibiting access of the tone signal data generation means to the memory means when the level monitor means detects that the level of the tone signal data monitored by the level monitor means is less than a specified value.

2. The tone signal generator as defined in claim 1, wherein said tone signal data generation means has a plurality of channels for generating the tone signal data, said level monitor means monitors the level of each of the channels, and said access control means inhibits the access to the memory means in each of the channels where the level monitor means detects that the level is less than the specified value.

3. The tone signal generator as defined in claim 1, wherein said access control means allows other process means, which perform a process other than generation of the tone signal data, to access the memory means when the access control means inhibits the access of the tone signal generation means.

4. The tone signal generator as defined in claim 1, wherein said parameter data is envelope wave data for imparting an envelope wave to the tone signal data.

5. The tone signal generator as defined in claim 1, wherein said parameter data is low frequency signal data for modulating the tone signal data.

6. The tone signal generator as defined in claim 1, wherein said level monitor means monitors the level of the tone signal data by detecting a level of the parameter data.

7. The tone signal generator as defined in claim 3, further comprising:

a memory access priority order table for storing a memory access priority order in which the access of the tone signal generation means to the memory means is defined as a first priority order and access of the other process means thereto is defined as a lower priority order, wherein said access control means controls the access to the memory means based on the memory access priority order table.

8. A tone signal generator comprising:

memory means for storing tone signal data;

parameter data generation means for generating parameter data;

tone signal data generation means for generating the tone signal data by reading it from the memory means;

fixing means for fixing the tone signal data generated by the tone signal data generation means to fixed data or outputting the tone signal data as it is;

envelope imparting means for generating envelope-imparted tone signal data by modulating output data from the fixing means with the parameter data; and access control means for inhibiting access of the tone signal data generation means to the memory means when the fixing means fixes the tone signal data to the fixed data.

9. A tone signal generator comprising:

memory means for storing tone signal data which includes attack data and following data for an attack phase and a following phase respectively of the tone signal data;

read control means for reading the tone signal data;

envelope data generation means for successively generating envelope data corresponding to the attack phase and the following phase of the tone single data;

envelope imparting means for imparting the envelope data to the tone signal data read by the read control means; and phase change control means for changing a phase of the envelope data generated by the envelope data generation means from the attack phase to the following phase, when the read control means ends reading of the attack phase of the tone signal data, in order to match a phase timing of the envelope data and the tone signal data.

10. The tone signal generator as defined in claim 9, wherein the read control means generates a control signal when it ends reading of the attack phase of the tone signal data, and the phase change control means changes the phase of the envelope data generated by the envelope data generation means from the attack phase to the following phase when the control signal is generated by the read control means.

11. The tone signal generator as defined in claim 10, wherein the envelope data generation means includes a selector for selecting a data change rate, before the control signal is generated by the read control means, the selector selects a first data change rate, and when the control signal is generated by the read control means, the phase change control means changes the phase of the envelope data from the attack phase to the following phase by causing the selector to select a second data change rate, which is different from the first data change rate.

12. A tone signal generator comprising:

a memory for storing tone signal data, the tone signal data including attack data for an attack phase of the tone signal data and following data for a following phase of the tone signal data;

a read controller for reading the tone signal data from the memory;

an envelope data generator for generating envelope data corresponding to the attack phase and the following phase of the tone single data; and an envelope imparting circuit for modifying the tone signal data read by the read controller based on the envelope data generated by the envelope data generator, wherein when the read controller ends reading of the attack phase of the tone signal data, a phase of the envelope data generated by the envelope data generator is changed from the attack phase to the following phase in order to match a phase timing of the envelope data and the tone signal data.

13. The tone signal generator as defined in claim 12, wherein the read controller generates a control signal when it ends reading of the attack phase of the tone signal data, and a phase change controller changes the phase of the envelope data generated by the envelope data generator from the attack phase to the following phase when the control signal is generated by the read controller.

14. The tone signal generator as defined in claim 13, wherein the envelope data generator selects a data change rate, before the control signal is generated by the read controller, the envelope data generator selects a first data change rate, and when the control signal is generated by the read controller, the phase change controller changes the phase of the envelope data from the attack phase to the following phase by causing the envelope data generator to select a second data change rate, which is different from the first data change rate.

15. A tone signal generator comprising:

a memory for storing tone signal data;

a tone signal data generator for generating the tone signal data by reading it from the memory; and a memory access controller, wherein the memory access controller inhibits access of the tone signal data generator to the memory when the level of the tone signal data is less than a specified value.

16. The tone signal generator as defined in claim 15, wherein the tone signal data read from the memory is modified by one of a group consisting of the tone signal data generator and another processing circuit, and the memory access controller inhibits access of the tone signal data generator to the memory when the level of the tone signal data as modified by one of the group consisting of the tone signal data generator and the other processing circuit is less than a specified value.

17. The tone signal generator as defined in claim 15, wherein the tone signal data generator has a plurality of channels for generating the tone signal data, and the memory access controller inhibits access to the memory for each of the channels where the level of the tone signal data is less than the specified value.

* * * * *